US008720408B1

(12) United States Patent
Neal et al.

(10) Patent No.: US 8,720,408 B1
(45) Date of Patent: May 13, 2014

(54) OIL FILTERING AND COOLING SYSTEM FOR A VEHICLE COMPRESSION IGNITION ENGINE

(76) Inventors: Kennieth Neal, Mesa, AZ (US); Gene Neal, Mesa, AZ (US)

( * ) Notice: Subject to any disclaimer, the term of this patent is extended or adjusted under 35 U.S.C. 154(b) by 225 days.

(21) Appl. No.: 13/405,102

(22) Filed: Feb. 24, 2012

Related U.S. Application Data

(60) Provisional application No. 61/463,917, filed on Feb. 24, 2011.

(51) Int. Cl.
*F01M 11/03* (2006.01)
*B21K 3/00* (2006.01)
*F01M 5/00* (2006.01)

(52) U.S. Cl.
CPC *F01M 11/03* (2013.01); *F01M 5/00* (2013.01)
USPC ..... 123/196 AB; 29/888.01; 184/104.3

(58) Field of Classification Search
CPC ..... F01P 9/00; F01P 11/00; F01P 5/10; F01P 3/20; F01P 11/16; F01P 3/08; F01P 7/12; F01P 9/047; F01P 11/03; F01P 11/02; F01P 1/08
USPC ..... 123/196 AB, 196 R, 41.33, 41.42; 184/6.5, 104.3; 29/888.01, 888.011
See application file for complete search history.

(56) References Cited

U.S. PATENT DOCUMENTS

| | | | |
|---|---|---|---|
| 5,406,910 | A | 4/1995 | Wallin |
| 5,746,170 | A | 5/1998 | Moriya |
| 6,253,837 | B1 | 7/2001 | Seiler |
| 7,540,431 | B2 | 6/2009 | Kozdras |

*Primary Examiner* — Noah Kamen
(74) *Attorney, Agent, or Firm* — John D. Titus

(57) ABSTRACT

An oil distribution system for a vehicle diesel engine having a replacement oil cooler block which directs oil to a remote oil filter block. Filtered oil is routed across the supply passage of a thermostat to an oil-to-air oil cooler. Oil from the cooler is directed via a return passage to the oil cooler block for distribution to the engine. The thermostat will bypass oil directly to the return passage when the oil temperature is below a preset level. The system may be an OEM system or a retrofit modification to existing engines. The system may include multiple oil-to-air heat exchangers and may be adapted to retain existing components such as a stock oil-to-coolant oil cooler.

13 Claims, 7 Drawing Sheets

Oil Cooler Block
112

188

OIL FILTERING AND COOLING SYSTEM FOR A VEHICLE COMPRESSION IGNITION ENGINE

CROSS-REFERENCE TO RELATED APPLICATION

This application claims the benefit of U.S. Provisional Patent Application No. 61/463,917 filed Feb. 24, 2011, the contents of which are hereby incorporated by reference.

TECHNICAL FIELD

This description relates generally to oil filtration and cooling systems and more specifically to oil cooling and filtration systems for automotive diesel engines, systems which may be provided as an OEM system or aftermarket modification.

BACKGROUND

Engine oil and filtration systems are designed to remove heat transferred to lubricating oil from the combustion process used to power the engine and combustion products and other oil contaminants. The presence of contaminants can lead to increased engine wear and premature failure of the engine. The combustion of fuel creates contaminants that are transferred to engine lubricating oil. Contaminants may also cause blockages in the lubricating circuits in the engine, adain leading to excessive engine wear, and premature failure. Reduction of lubricating oil temperature may also be desirable to prevent temperature build up in the engine, and the resulting problems that may be caused by an excessively hot engine.

The oil distribution and cooling and filtration systems of conventional diesel engines often present problems as the oil cooler is top mounted in the engine valley on an oil filter base. The oil filter base includes, an oil drain to drain oil from the housing during an oil change. If the oil drain becomes clogged, the result may be oil spillage during an oil change once the filter is removed. A faulty drain valve can also result in a critical and potentially damaging loss of lubricating oil.

Another problem with conventional oil cooler and filter systems is that engine compartment space limitations present difficulty and obstruction to modifying the oil and cooling systems to enhance performance and engine durability As evidenced by the great number of automotive repair shops engine failure remains a prevalent problem. Accordingly an improved system and method of cooling and filtering engine oil is desirable.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

Briefly, the present invention provides an improved oil distribution, filtering and cooling system which is particularly adapted to diesel engines. The improved system of the present invention, which may be an OEM install or may be retrofitted to an existing engine, includes an oil cooler block or manifold which, in one example, replaces the stock oil cooler and cover and is mounted in place of the stock engine oil cooler which is removed. The configuration of the replacement block or manifold allows utilization of OEM gaskets and mounting hardware.

Engine oil is directed by the replacement oil transfer block to an oil filter. The oil filter is remotely mounted on an oil filter block having mounting flanges preferably conforming to existing mountings holes located in the engine compartment and which were previously used for mounting the stock OEM oil filter block. The replacement oil filter block has threads for receiving a spin-on oil filter. The block has internal passageways to direct oil to the filter and direct filtered oil to an air-to-liquid oil cooler across a thermostatic bypass which preferably also incorporates a pressure relief valve. The bypass will shunt or return filtered oil to the oil cooler block when the oil temperature is below a pre-set level.

The air-to-liquid cooler is located in the engine compartment area for maximum heat transfer and cooling positioned to be subject to unobstructed direct airflow such as on the vehicle bumper or immediately behind the grill. In normal operation, cooled oil flows from the oil cooler and returns to the oil transfer block to be distributed to the various engine oil circuits.

In an alternate arrangement, the oil cooling system may utilize the OEM stock cooler and cover, directing the oil to a replacement oil filter block, oil filter and to an air-to-liquid oil cooler. This hybrid system has the advantage of initially cooling the oil in the stock liquid-to-liquid cooler and further cooling the oil in an additional air-to-liquid cooler.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe an engine oil filtering and cooling system and method. Although the present examples are described and illustrated herein as being implemented in a diesel engine system, the system described is provided as an example and not a limitation. As those skilled in the art will appreciate, the present examples are suitable for application in a variety of different types of oil filtering and cooling systems.

Diesel or compression ignition engines are widely used in both light and heavy duty trucks. The well know Ford® F Series and E Series product lines of vehicles utilize diesel engines. These diesel engine designs may have an oil cooler that is mounted in the bed or valley on the top of the engine beneath an oil filter which is typically a canister-style filter.

Oil may be drawn from the oil pan or reservoir and directed by an oil pump to the top mounted oil cooler and then flow to the oil filter. Oil to be cooled is routed to the oil cooler by passageways in the oil filter base to a stock plate-style liquid-to-liquid heat exchanger in heat exchange relationship with engine coolant. The coolant passes through the oil cooler and is then directed by passageways into an exhaust gas recirculation (EGR) cooler. The cooled and filtered oil is directed to various engine locations requiring lubrication and other locations such as the oil reservoir for the high pressure pump, the injection galleries and to a turbo charger, if the engine is so equipped.

Figure 1:
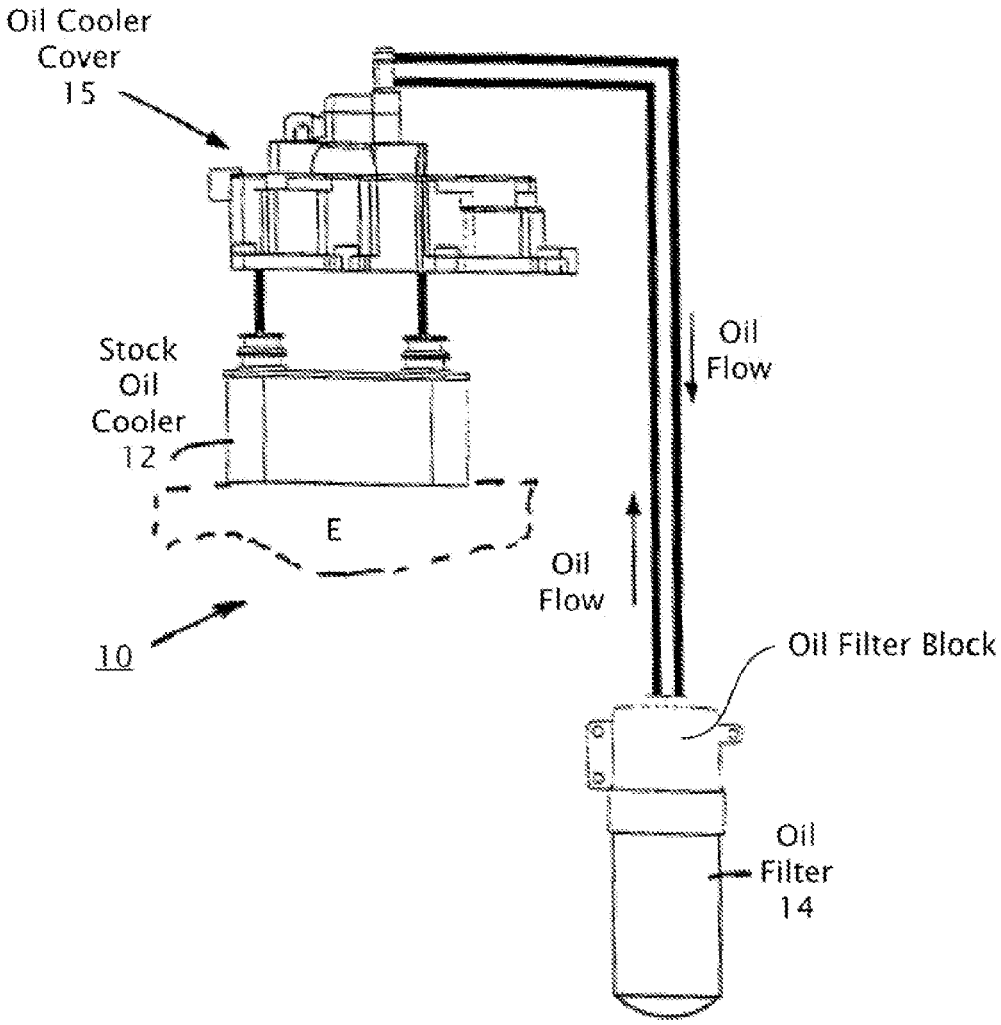
PRIOR ART FIG. 1
FIG. 1 is a schematic of a standard or stock oil system typically provided by the automotive manufacturer.

FIG. 1 is a schematic diagram showing a standard oil routing system as provided by some manufacturers. The schematic shows an exemplary Ford® E Series Power Stroke 6.0L diesel engine but is representative of other oil distribution systems.

The OEM stock system 10 may utilize a liquid-to-liquid stacked plate heat exchanger 12 mounted in the valley area of the engine E. Aluminum fins and divider plates that may be part of the heat exchanger separate the oil and engine coolant flowing through the cooler, as well as facilitate the exchange if heat. This fin and plate construction typically forms narrow passage ways that may be prone to blockage by contaminants, particularly present in the oil.

Heat is exchanged from the oil to engine coolant in the heat exchanger 12 to the engine coolant. The engine oil may be circulated by an oil pump present in the oil flow circuit coupled to the heat exchanger 12.

A coolant pump, not shown, may be coupled to and directs coolant through the heat exchanger 12. In the heat exchanger heat is transferred from the oil to the engine coolant to reduce the temperature of the oil. exiting coolant may pass to an EGR cooler, not shown.

The cooled oil exiting the heat exchanger may then be directed to an oil filter 14. In the filter combustion products and other contaminants may be filtered out of the oil. Filtered oil from the filter may be directed to various engine locations.

Oil cooler cover 15 may be coupled to the filtered oil output of oil filter 14. The oil cooler cover may also direct the flow of clean oil. For example, filtered oil may be directed to low and/or high pressure oil circuits where it may be used for lubrication (low pressure circuit), for actuation of electro-hydraulic fuel injectors (high pressure circuit), or other suitable purposes.

There may be problems with OEM systems of this type. The oil-to-coolant oil cooler 12, may incorporate a stacked plate and fin design which inherently defines numerous small fluid passageways which form an efficient heat exchanger structure. The heat exchanger design is a problem because such passage ways may be susceptible to becoming blocked over a period of use, a situation that is not aided by filtering the oil after it exits the heat exchanger.

As a consequence of the conventional design of an OEM oil cooler system particulates in the unfiltered oil exacerbate the potential for restriction or clogging of the oil cooler because of the order of component placement. The oil filter 14 in an OEM system is typically located downstream of the oil cooler. Since some of the unfiltered oil is passed through the confined passageways of the oil cooler, the oil cooler may in fact act as the primary filter as particles may tend to be caught in the heat exchanger passages.

A blocked exchanger can lead to reduced flow of oil and a temperature rise in the oil that does flow through the heat exchanger.

A further problem may be encountered in the coolant section of the heat exchanger. This section is also susceptible to blockage by contaminants, reducing heat transfer. And finally if the temperatures rise too much ruptures or leaks may be formed between the physical barriers separating the coolant and the oil, allowing mixture of the fluids.

Figure 2:
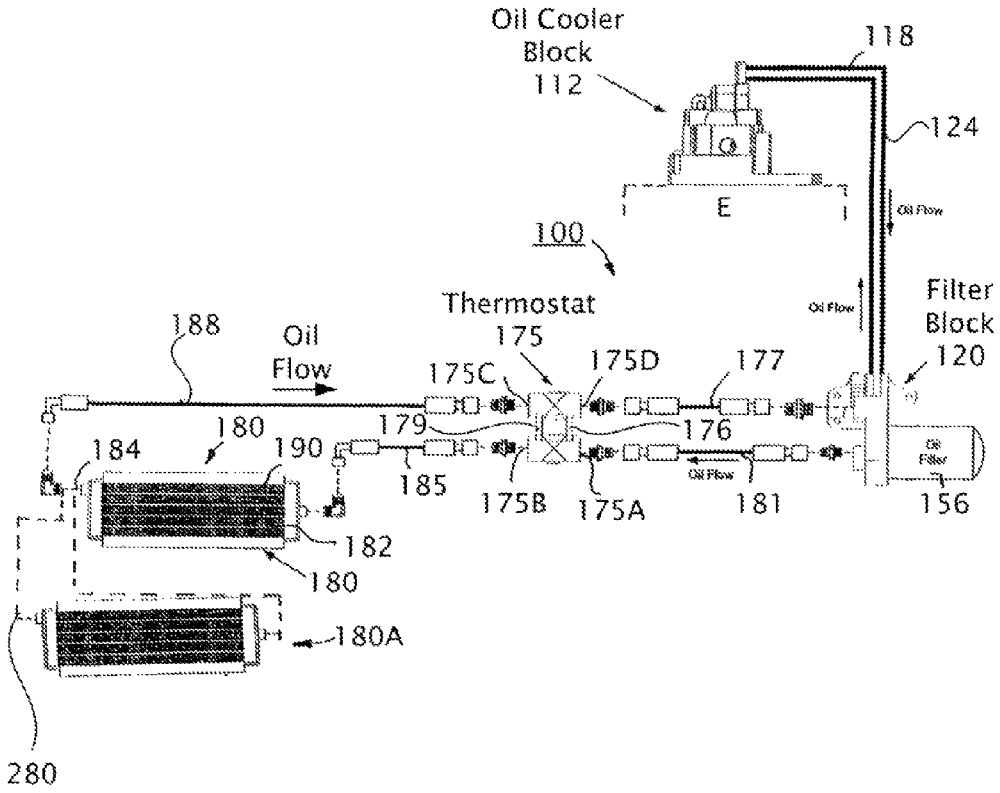
FIG. 2 is a schematic of an embodiment of the improved oil filtering and cooling system of the present invention.

FIG. 2 is a schematic diagram showing the oil filtering and cooling system of the present invention. The cooling system is shown in connection with a representative engine E. The exemplary system may be provided as an OEM system or a modification or replacement system for OEM systems of the type described with reference to FIG. 1. The system of the present invention is generally designated by the numeral 100.

The system 100 includes a specially constructed oil cooler block 112 which may mount in the valley of the engine E replacing the conventional oil cooler normally in this location.

Thermostat 175 has a temperature element which may be an electric sensor or may be a cartridge-type element, having a diaphragm to regulate flow bypassing the cooler until minimum oil temperatures are reached. When oil entering the thermostat is below a certain temperature, the thermostat is open allowing oil to bypass the cooler 180, returning to the oil cooler block 112 via the oil filter body 120. The thermostat 175 has a supply side with an inlet 175A and outlet 175B. The return side of the thermostat has an inlet 175C and an outlet 175D. Cold oil entering the thermostat is bypassed through 176 and returned to the engine. As the oil heats due to increasing engine temperature, the thermostat 175 begins to close, restricting bypass 176, forcing more oil to the cooler 180 at outlet 175B. At a maximum present temperature, the thermostat fully closes the bypass 176 and the entire engine oil flow is directed through the cooler 180.

The thermostat 175 may also include a pressure bypass element 179 in the bypass 176. In the event the system pressure increases due to a restriction or blockage in the cooler 180 or reduced flow capacity, the pressure relief element 179 will allow the bypass to partially open, overriding the temperature actuation, and relieving the pressure buildup. Thermostats having temperature elements which include a pressure relief valve of this type are available from various manufacturers and are well known in the art.

Outlet 175B of thermostat 175 is connected by suitable fittings to oil line 185 and to the inlet of the oil cooler 180. The oil cooler 180 has an exterior housing of aluminum or stainless steel. A series of tubular oil passageways 182 extend from the cooler inlet to the cooler outlet 184 which communicates with the thermostat return inlet via cooled oil supply line 188. The oil passageways in the oil cooler are provided with fins 190 or other heat exchange enhancing features.

The air-to-liquid cooler 180 is mounted in a suitable location such as on the vehicle bumper or other location for maximum heat transfer. The engine fan also operates to move air through the oil cooler if the cooler 180 is properly placed rearward of the condenser so that even under extended idle conditions, the engine fan will provide an adequate airflow through the cooler across the heat exchange tubes. The enhanced cooling eliminates the problem of early system failure and engine wear due to overheated engine oil. Mixing of coolant and oil is also avoided as the cooler is an air-to-liquid cooler. Engine oil temperatures are independent of coolant temperatures and adequate coolant supply which, if not proper, would be harmful to a conventional coolant-based oil cooling system.

Return oil enters the oil filter block 120 to be directed by line 124 to the oil cooler block 112. The fully filtered and cool oil is then directed by the block 112 to the various engine oil circuits. A high pressure oil pump filter screen 190 integrated in the block 112 provides additional protection in the event the OEM screen becomes damaged. The screen 190 is a stainless steel mesh for durability.

The oil filtering and cooling system of the present invention is highly versatile. For example, additional oil coolers 180A can be added to the system for increased cooling. This can be accomplished by installing multiple coolers 180, 180A in series, with suitably constructed additional oil lines shown in dotted lines 280, each would preferably be located for optimum airflow across the heat exchange element.

Figure 3:
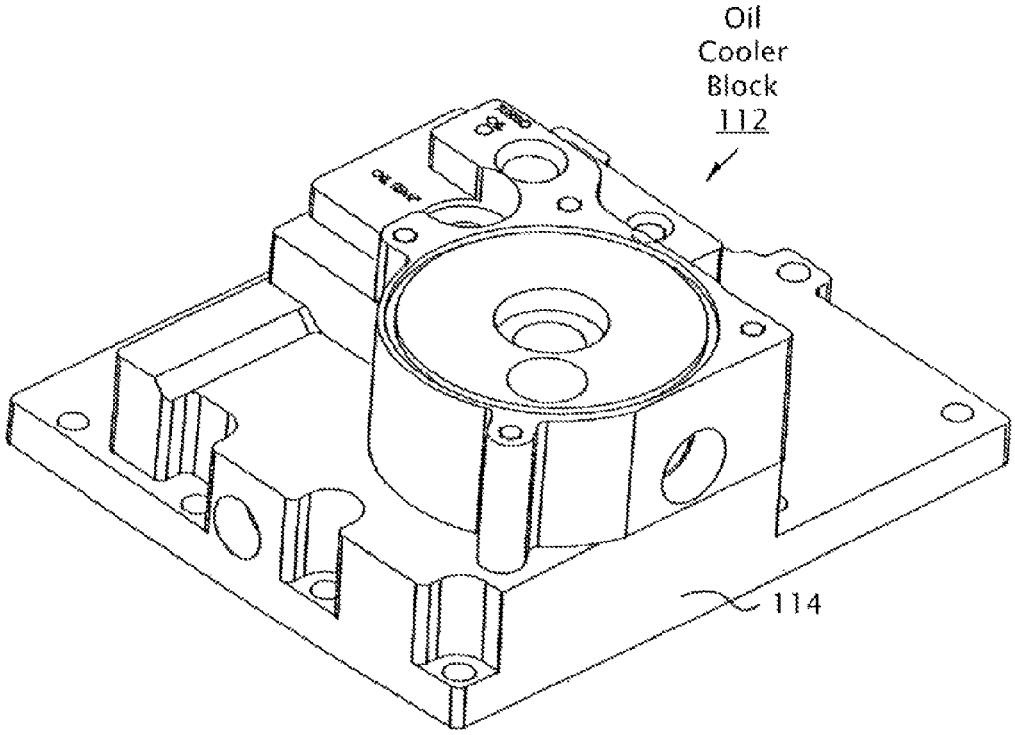
FIG. 3 is a perspective view of the oil cooler block or manifold utilized in the present invention.

FIG. 3 is a perspective view of the oil cooler block or manifold (112 of FIG. 2) utilized in the present invention. The oil cooler mounting block (112 of FIG. 2) has a body 114 of steel or other suitable material.

Figure 4:
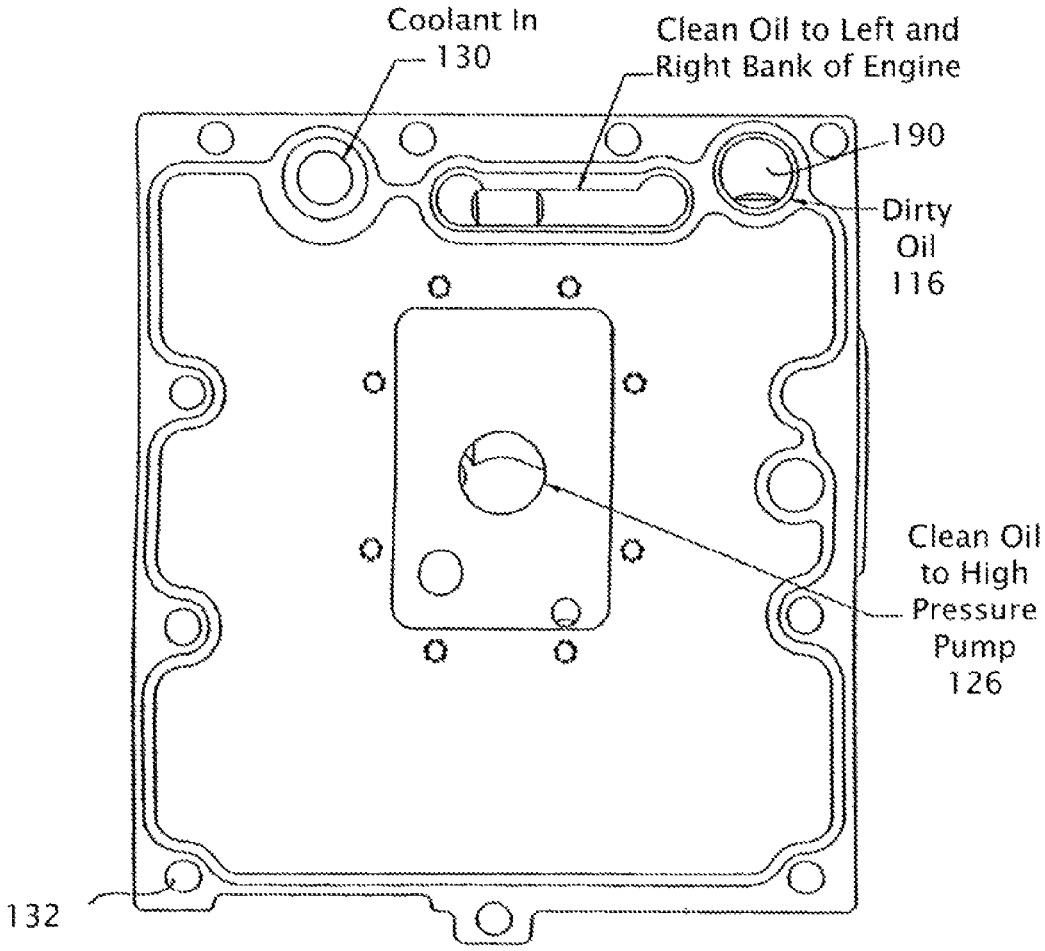
FIG. 4 is a bottom plan view of the oil cooler block which mounts and is compatible with existing oil cooler engine mountings.

FIG. 4 is a bottom plan view of the oil cooler block (112 of FIG. 2) which mounts and is compatible with existing oil cooler engine mountings. The oil cooler mounting block (112 of FIG. 2) is internally machined having a passageway 116 which receives oil from the crankcase and routes it via oil line 118 to the oil filter block (120 of FIG. 2). The oil cooler block 112 receives cooled and filtered oil via return line 124 which is then directed at 126 to the oil reservoir from the high pressure pump. Passageways 116, 126 and 130, for dirty oil, clean oil and coolant, respectively, align with the existing passageways on the engine block E.

Since the present system utilizes a liquid-to-air heat exchanger to cool the oil, any existing coolant passageways in the existing oil cooler mounting plate are sealed by the oil cooler block at 130. The oil cooler block has mounting bores 132 which align with the existing threaded mounting bores in the engine E.

Figure 5:
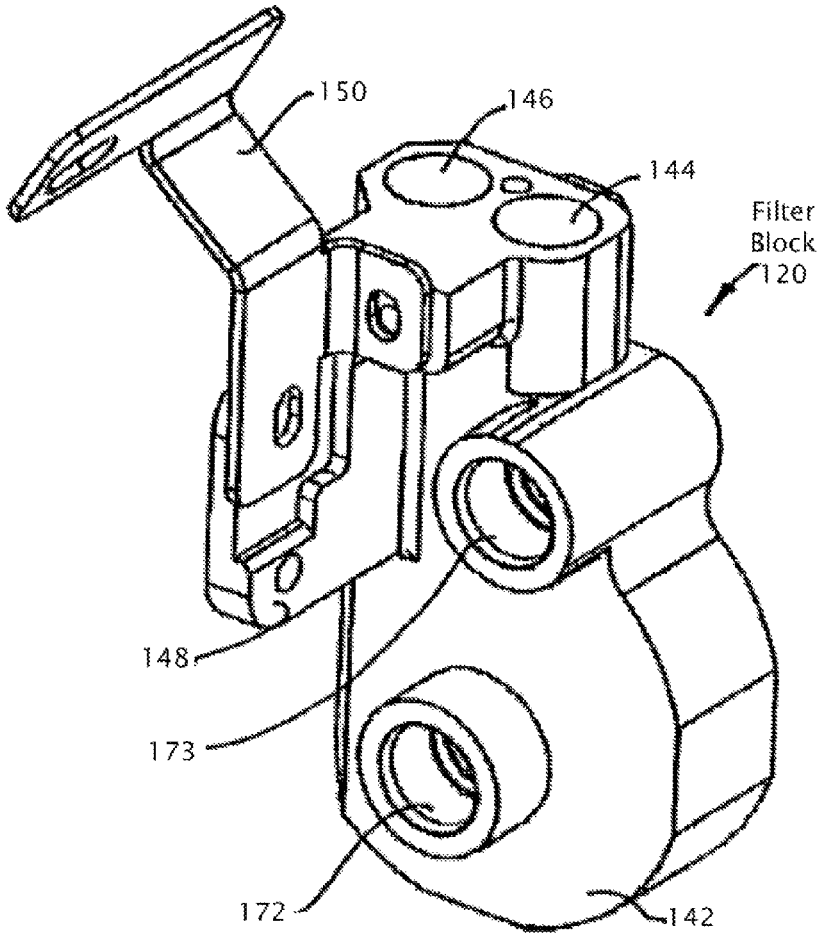
FIG. 5 is a perspective view showing one side of the oil filter block or manifold utilized in the system of the present invention.

FIG. 5 is a perspective view showing one side of the oil filter block or manifold utilized in the system of the present invention. The oil filter block 120 has a body 142 of machined or a cast material, such as aluminum, having an inlet 144 connected to oil line 118 (of FIG. 2). Outlet 146 returns oil via line 124 (of FIG. 2) to the oil cooler block (112 of FIG. 2) for distribution to the engine.

The oil filter block 120 has mounting flanges 145 (FIG. 6), 148 which have mounting holes positioned to align with existing mounting holes located on the engine to which the oil filter block is normally mounted. Because of the location of the oil filter block, existing OEM steel lines 118, 124 can be used to connect the oil filter block 120 to the oil cooler block 112. In some installations, a bracket 150 may be fabricated and attached to the oil filter block to facilitate mounting.

Filtered oil exits from the filter block at outlet 172. The outlet 172 is connected by suitable fittings to line 181 connected to thermostat 175. Return oil enters the oil filter block at 173 to be directed by line 124 to the block 112.

Figure 6:
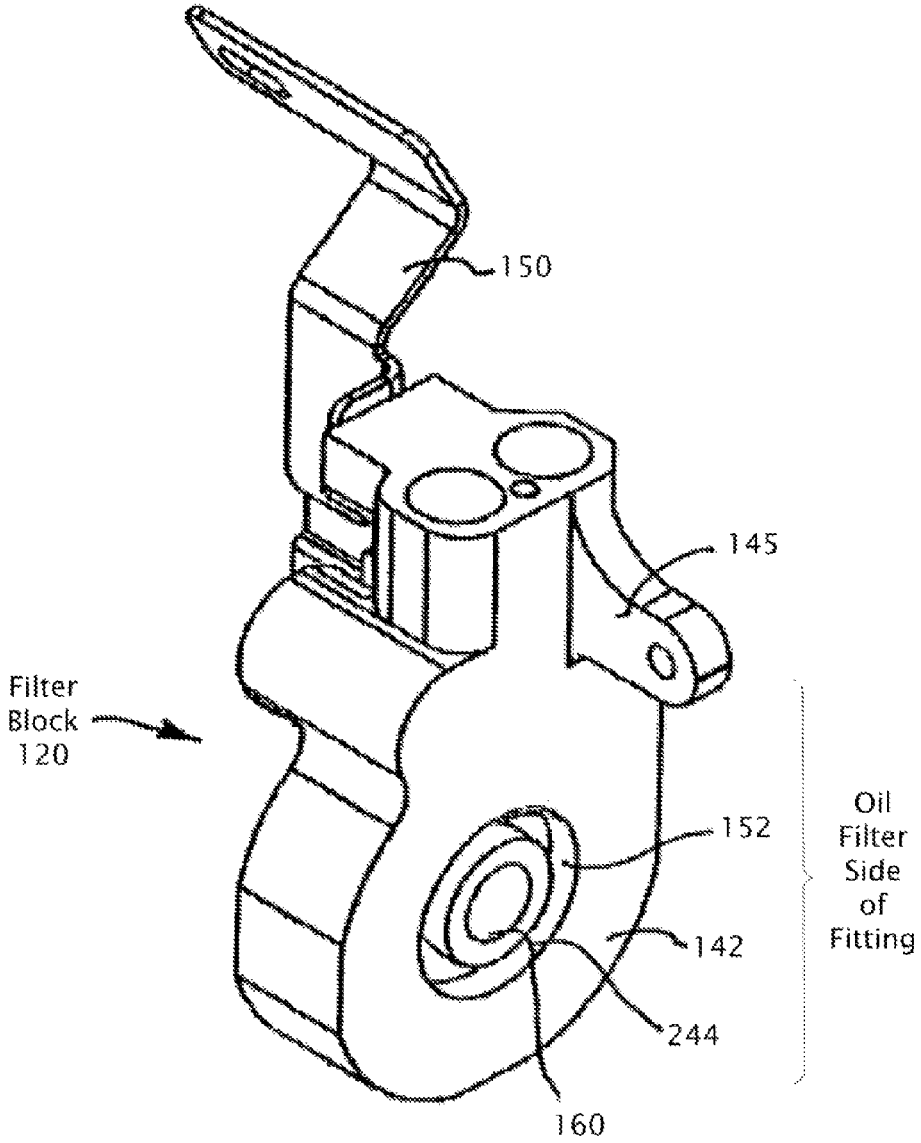
FIG. 6 is a perspective view showing the opposite sides of the oil filter block as seen in FIG. 5.

FIG. 6 is a perspective view showing the opposite sides of the oil filter block (120 of FIG. 2) pictured in FIG. 5. A surface of the oil filter block 120 (120 of FIG. 2) defines receptacle threads 152 to which a screw-on, canister-style oil filter (156 of FIG. 2) may be attached. A peripheral passage 160 internally communicates with inlet 244 to supply oil to the filter. The oil to be filtered enters the filter under pressure through holes around the base of oil filter (156 of FIG. 2). The oil then passes through filter media and flows to a central tube where it enters central passageway 160.

Figure 7:
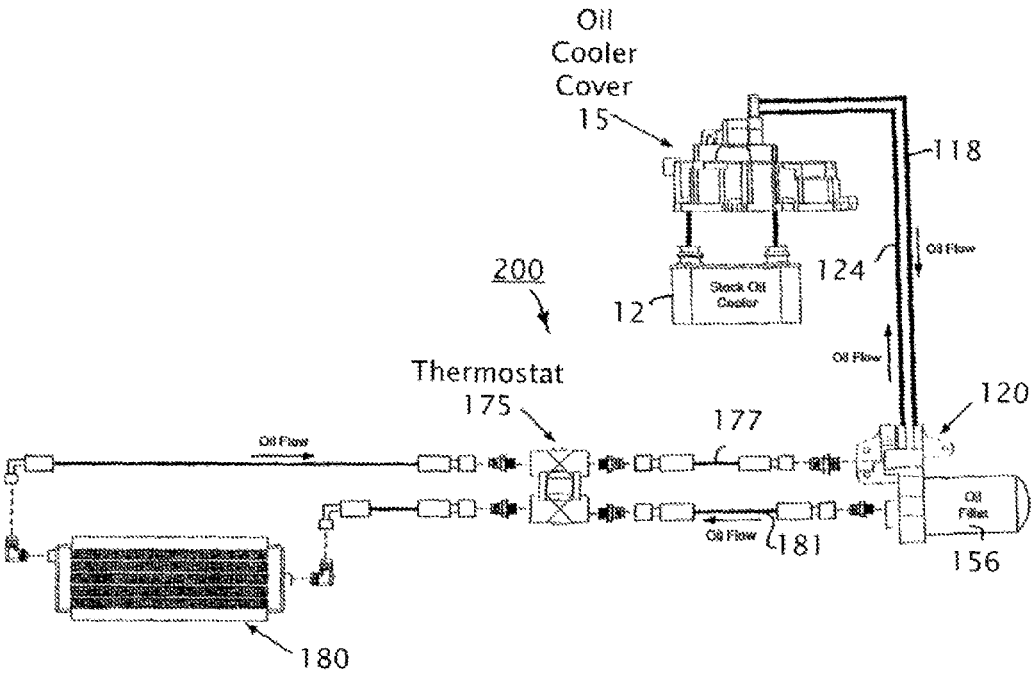
FIG. 7 is a schematic diagram of another embodiment of a replacement oil filtering and cooling system of the present invention utilizing the existing stock oil cooler as found on many engines.

FIG. 7 shows an alternate oil filtering and cooling system utilizing multiple heat exchangers termed a "hybrid system" since the system retains the stock or OEM liquid-to-liquid engine oil cooler 12 located in the valley on the engine. The hybrid replacement or modified system is designated by the numeral 200 and incorporates the existing stock oil cooler 12 and oil cooler cover 15, as seen in FIG. 1. There are installations where it may be desirable to maintain these components, resulting in a hybrid system incorporating the OEM stock oil liquid-to-liquid with added cooling capacity provided by air-to-liquid cooler 180. With the hybrid system 200, oil is initially cooled in the stock liquid-to-liquid oil cooler 12 and thereafter routed by the oil cooler cover 15 via line 118 to an oil filter 156 remotely mounted on an oil filter block 120, as described above.

Oil is directed by the thermostat 175 to either the oil cooler 180 returning to the oil cooler cover 15 via lines 188, 177 and 124 for distribution to the engine, or is shunted to line 124 bypassing the cooler. The same numerals are used in the hybrid schematic system shown in FIG. 5 to represent the same or substantially similar elements or components previously described to avoid repetition.

It will be obvious to those skilled in the art to make various changes, alterations and modifications to the invention described herein. To the extent such changes, alterations and modifications do not depart from the spirit and scope of the appended claims, they are intended to be encompassed therein.

Those skilled in the art will realize that the process sequences described above may be equivalently performed in any order to achieve a desired result. Also, sub-processes may typically be omitted as desired without taking away from the overall functionality of the processes described above.

The invention claimed is:

1. An oil filtering and cooling system in combination with a vehicle engine having a mounting location for an oil cooler on the engine, the location having existing passageways for a coolant supply, oil to be filtered and clean oil supply, the system comprising:

(a) an oil cooler block having a mounting plate having passageways compatible with the existing oil passageways in the engine and a seal aligning with the existing coolant supply passageway;

(b) an oil filter block having a first inlet communicating with the oil to be filtered passageway of the oil cooler block and a first outlet communicating with the clean oil in passage in the oil cooler block;

(c) the oil filter block having a receptacle for an oil filter and passageways for directing oil to the filter and a second outlet for filtered oil and a second inlet for return oil;

(d) a thermostat having a body having a supply passageway communicating with the oil filter block second outlet and a return passageway communicating with the oil filter block second inlet, the thermostat having a thermostatic bypass element operatively connected between the supply and return passageways to bypass oil to the return when the oil temperature is below a preset temperature, the return passageway communicating with the oil filter block; and (e) a first air-to-liquid heat exchanger having an inlet connected to the supply passage of the thermostat and an outlet connected to the return passage of the thermostat, the heat exchanger being mounted in an airflow path in a vehicle.

2. The oil filtering and cooling system of claim 1 wherein the thermostat includes a pressure responsive element to direct oil to the return passage when the pressure differential across the heat exchanger exceeds a predetermined setting.

3. The oil filtering and cooling system of claim 1 wherein the oil cooler block includes a stainless steel oil filter screen.

4. The oil filtering and cooling system of claim 1 wherein the oil cooler block has mounting holes located to conform to existing mounting locations on the engine.

5. The oil filtering and cooling system of claim 1 wherein the oil filter receptacle is threaded to receive a spin-on oil filter.

6. The oil filtering and cooling system of claim 1 further including a second air-to-liquid oil cooler connected in series with the first air-to-liquid oil cooler.

7. An oil filtering and oil cooling system in combination with a vehicle engine having a coolant-to-oil oil cooler and an oil cooler cover mounted on the engine, the oil cooler having an outlet for cooled, unfiltered oil and a return inlet for filtered oil, the system comprising:

(a) an oil filter block having a first inlet communicating with the oil outlet passage of the oil cooler block;

(b) the oil filter block having a receptacle for an oil filter and passageways for directing oil from the first inlet to the filter and a first outlet for filtered oil;

(c) a thermostat having a body having a supply passage connected to the first outlet of the oil filter block and having a return passage connected to the oil cooler block via the filter block, the thermostat having an element to bypass oil from the supply passage to the return passage when the oil temperature is below a preset temperature; and (d) an air-to-liquid heat exchanger having an inlet connected to the supply passage of the thermostat and an outlet connected to the return passage of the thermostat, the heat exchanger being mounted in an airflow path in the vehicle.

8. A method of modifying an automotive engine having a stock coolant-to-oil oil cooler with an oil cooler cover mounted on the engine, the engine having oil supply and oil return lines, the method comprising:

(a) removing the stock oil cooler and oil cooler cover from their mounting locations;

(b) mounting an oil cooler block having passageways compatible with the oil passageways in the mounting location and having a seal aligned with the existing coolant supply port in the mounting location;

(c) mounting an oil filter block remotely from the oil cooler block, the oil filter block having a receptacle for an oil filter, the oil filter block having a passageway communicating the oil supply with the oil filter and having a first supply outlet for filtered oil and a return oil outlet;

(d) connecting the oil supply oil passage on the oil cooler block with the supply passage of the oil filter block;

(e) connecting the return oil outlet on the oil filter block to the return line of the oil cooler block;

(f) providing a thermostat having a body with a supply passage and a return passage with a bypass element connected between the passageways to bypass oil when the oil temperature is below a predetermined level;

(g) mounting an air-to-liquid heat exchanger having an inlet and outlet in the engine area in position to receive airflow when the vehicle is operating;

(h) connecting the inlet of the heat exchanger to the supply passage of the thermostat;

(i) connecting the outlet of the heat exchanger to the return passage of the thermostat; and (j) connecting the return passage to the engine cooler cover via the oil filter block.

9. A method of modifying an automotive engine having a stock coolant-to-oil cooler and an oil cooler cover mounted on the engine, the engine having existing passageways for a coolant supply, oil to be cooled and cool oil return, the method comprising:

(a) removing the stock oil cooler and oil cooler cover from their mounting locations;

(b) mounting an oil cooler block at the mounting location of the removed stock oil cooler and cover;

(c) routing a flow of oil from the engine through the oil cooler block to a remotely mounted oil filter block having a filter;

(d) routing the flow of oil through the oil filter to an outlet on the oil filter block;

(e) mounting a liquid-to-air heat exchanger having an inlet and an outlet at a location remote from the engine;

(e) routing the flow of oil to the inlet of the liquid-to-air heat exchanger; and (h) routing the flow of oil from the liquid-to-air heat exchanger to the oil cooler block, whereby cooled filtered oil is returned to the oil return passage of the engine.

10. The method of claim 9, further comprising:

providing a thermostat module disposed in a flow path between the oil filter block and the liquid-to-air heat exchanger, the thermostat module having a supply passage, an outlet, and a return passage, the thermostat module further comprising a thermostatic element disposed between the supply passage and the return passage, the thermostatic element moving from a first position in which the flow of oil is directed to the return passage toward a second position in which the flow of oil is directed to the liquid-to-air heat exchanger in response to increasing temperature of the flow of oil.

11. The method of claim 10, further comprising:

providing a pressure relief element, the pressure relief element moving from a first position in which the flow of oil is directed to the liquid-to-air heat exchanger to a second position in which the flow of oil is directed to the return passage in response to increasing differential pressure between the engine oil to be cooled and the engine cool oil return.

12. The method of claim 9, wherein:

The flow of oil passes through the oil filter before passing through the liquid-to-air heat exchanger.

13. The method of claim 9, wherein:

the oil cooler block is mounted so that the existing passageway for the coolant supply is sealed.

* * * * *